US005841223A

United States Patent [19]

Muramatsu et al.

[11] Patent Number: 5,841,223

[45] Date of Patent: Nov. 24, 1998

[54] COLOR CATHODE RAY TUBE AND METHOD OF MANUFACTURING THE SAME

[75] Inventors: Sachiko Muramatsu, Tatebayashi; Yasuhisa Ohtake, Fukaya, both of Japan

[73] Assignee: Kabushiki Kaisha Toshiba, Kawasaki, Japan

[21] Appl. No.: 378,719

[22] Filed: Jan. 25, 1995

[30] Foreign Application Priority Data

Jan. 26, 1994 [JP] Japan ..... 6-006713
Jan. 10, 1995 [JP] Japan ..... 7-002142

[51] Int. Cl.[6] ..... H01J 29/07

[52] U.S. Cl. ..... 513/402; 315/407

[58] Field of Search ..... 313/402, 403, 313/407, 408

[56] References Cited

U.S. PATENT DOCUMENTS

| | | | |
|---|---|---|---|
| 4,442,376 | 4/1984 | Van Der Waal et al. . | |
| 4,716,333 | 12/1987 | Kiyoshi et al. . | |
| 4,734,615 | 3/1988 | Koike et al. . | |
| 4,751,424 | 6/1988 | Tong | 313/402 |
| 4,884,004 | 11/1989 | Deal et al. | 313/402 |
| 4,983,136 | 1/1991 | Okuda . | |
| 5,017,830 | 5/1991 | Koike | 313/403 X |
| 5,028,836 | 7/1991 | Hirasawa | 313/402 |
| 5,170,093 | 12/1992 | Yamamoto et al. . | |

FOREIGN PATENT DOCUMENTS

| | | |
|---|---|---|
| 0403219 | 12/1990 | European Pat. Off. . |
| 4225446 | 12/1967 | Japan . |
| 6054139 | 3/1985 | Japan . |
| 601459 | 4/1985 | Japan . |
| 62-110240 | 5/1987 | Japan . |
| 62-283527 | 12/1987 | Japan . |
| 6481139 | 3/1989 | Japan . |
| 4-48530 | 2/1992 | Japan . |

OTHER PUBLICATIONS

Patent Abstracts of Japan, vol. 010, No. 244 (E–430), Aug. 22, 1986 & JP–A–61 074243.

*Primary Examiner*—Ashok Patel
*Attorney, Agent, or Firm*—Pillsbury Madison & Sutro LLP

[57] ABSTRACT

A color cathode ray tube is disclosed in which a coating containing an aluminum phosphorus compound and fine particles of at least one of tungsten oxide and bismuth oxide and is formed on the surface of a shadow mask on the side of an electron gun.

12 Claims, 2 Drawing Sheets

COLOR CATHODE RAY TUBE AND METHOD OF MANUFACTURING THE SAME

BACKGROUND OF THE INVENTION

1. Field of the Invention

The present invention relates to a color cathode ray tube and, more particularly, to an improvement in a shadow mask for use in a color cathode ray tube.

2. Description of the Related Art

The shadow mask of a color cathode ray tube has a large number of apertures. These apertures are so designed as to have a geometrical one-to-one correspondence with phosphor layers. Each aperture thus designed passes an electron beam emitted from an electron gun, the passed electron beams each being incident on a corresponding phosphor layer which is in a geometrical one-to-one correspondence with that aperture. Therefore, the aperture is also called a color selecting electrode.

In a typical color cathode ray tube, about 15% to 20% of an entire electron beam emitted from an electron gun reaches phosphor screen through the apertures of a shadow mask, and the remaining 80% to 85% portion of the beam is incident on the surface of the shadow mask. As a result, the kinetic energy of the electron beam is converted into a thermal energy that heats the shadow mask to about 80° C. Generally, the base material used in the shadow mask is a cold-rolled iron plate 0.1 to 0.3 mm in thickness whose thermal expansion coefficient is $12\times10^{-6}$/°C. at 20° C. to 100° C. When heated as described above, the shadow mask causes thermal expansion generally referred to as doming. This thermal expansion brings about a geometric positional deviation between the apertures of the shadow mask and a phosphor layer. Consequently, a portion of an electron beam passing through the apertures is incident on a phosphor layer of another color, leading to a purity drift.

To improve a color cathode ray tube which causes a significant purity drift due to the doming phenomenon, Jpn. Pat. Appln. KOKOKU Publication No. 42-25446, e.g., has proposed the use of an iron-nickel alloy, such as an invar alloy, whose thermal expansion coefficient is nearly 1/10 that of iron. Unfortunately, the invar alloy is expensive, having a high yield strength after annealing and a low yield in mask molding. Therefore, color cathode ray tubes using such an invar alloy are very expensive compared to those using iron.

For this reason, a coating has conventionally been formed on the surface of a shadow mask for suppressing a purity drift caused by the doming.

The above-mentioned prior art will be further described below.

In a first method, as proposed in Jpn. Pat. Appln. KOKAI Publication No. 60-54139, crystallized glass formed from lead borate is coated on the surface of a shadow mask and bonded by a high-temperature heat treatment to suppress doming. This method incorporates lead, a harmful substance, into the glass layer. Therefore, extraordinary safety measures must be undertaken in handling the material to ensure a safe working environment and to prevent an environmental pollution.

A second method uses a coating solution containing particles of a heavy metal substance whose atomic number exceeds 70, as proposed in Jpn. Pat. Appln. KOKOKU Publication No. 60-14459. In this method, the coating solution is spray-coated on the surface on the electron beam incident side of a shadow mask to form a coating having an electron beam reflecting property. In this method, a water-soluble suspension containing fine particles of a heavy metal, such as bismuth oxide, must also be sprayed on the electron beam incident surface of the shadow mask after the formation of the coating. Therefore, the effectiveness of this method in preventing the purity drift resulting from the doming of the shadow mask depends solely upon a single element, such as bismuth oxide. The effectiveness of this method is therefore unsatisfactory when compared with the effectiveness of a shadow mask having no electron beam reflecting coating.

A third method suppresses doming by increasing the thermal conductivity or thermal radiation efficiency of the shadow mask, while imparting the electron beam reflecting property discussed above. As a method of this sort, Jpn. Pat. Appln. KOKAI Publication No. 4-48530 describes a method of forming a solution by mixing bismuth oxide particles, tungsten particles, and partially graphitized carbon particles with water glass, and forming a composite coating on the electron beam incident surface of the shadow mask by coating the solution on a shadow mask. Through this method, the purity drift preventing effect is relatively good. However, since the particle sizes of the raw materials are large, it is difficult to uniformly mill the materials even if the materials are milled and stirred to have an average particle size of, e.g., approximately 2 $\mu$m by using a ball mill or the like. Consequently, it is difficult to obtain a sharp particle size distribution of the milled particles. In order to prevent deformation or clogging of the mask apertures, the thickness of the coating must be controlled to about 3 $\mu$m. However, since substances having no sharp particle size distributions and different specific gravities are mixed, it is impossible to obtain a homogeneous mixture as the coating solution. This inhomogeneous coating solution cannot be spray-coated, rendering it is difficult to perfectly coat a shadow mask with this coating solution.

A fourth method is disclosed in Jpn. Pat. Appln. KOKAI Publication NO. 62-110240. In this method, an amorphous metal oxide material or the like is used as a binder to form a layer containing a metal with a small atomic number, thereby improving the thermal radiation efficiency. In addition, a purity drift is prevented by performing electrostatic correction for the electron beam path by electrification.

As described above, a coating has been formed on the surface of a shadow mask using various methods to suppress the doming of the shadow mask. Because the coating used in each method is formed from a substance which does not melt at temperatures applied during the color cathode ray tube manufacturing process, water glass or a metal alkoxide must be used as a binder to allow film formation.

Since, however, water glass contains an alkali metal, a carbonate is also readily formed. This carbonate produces carbonic acid gas in a heat treatment during the manufacture, and a portion of the gas is readily adsorbed in the tube. The carbon dioxide adsorbed is released to poison the cathode an electron beam is incident upon the cathode ray tube while in operation. When the carbon dioxide is released the emission characteristics are degraded. Furthermore, a metal alkoxide does not form a perfect metal oxide when subject to a heat treatment of about 500° C. Due to these imperfections, hydrogen gas is produced during operation of the color cathode ray tube. The product ionized hydrogen gas impinges causes ion burn on the phosphor screen, resulting in a decreased luminance.

SUMMARY OF THE INVENTION

The present invention has an object to solve the above conventional problems by providing a color cathode ray tube having a coating made from an inorganic material formed on the surface of a shadow mask. The coating reduces thermal expansion otherwise caused by heat generated when an electron beam,is incident upon the shadow mask, thereby reducing a purity drift resulting from doming and a degradation in the emission life.

In addition, in the manufacturing process of a color cathode ray tube, a shadow mask is spray washed with water, and heated during sealing and evacuation. Therefore, a coating to be formed on the surface of a shadow mask is preferably resistant to both water and heat. Unfortunately, a heat treatment at 500° C. or higher is required to form a coating having such properties using conventionally proposed binders. This increases the thermal economic burden.

It is, therefore, another object of the present invention to provide a color cathode ray tube including a shadow mask having a coating that is resistant to both water and heat.

The present invention includes the following two aspects.

The first aspect of the present invention is a color cathode ray tube comprising:

a phosphor screen;

a shadow mask with a large number of apertures, arranged in the vicinity of the phosphor screen; and an electron gun generating an electron beam passing through the apertures of the shadow mask to excite the phosphor screen, wherein the shadow mask has a coating which is formed on an electron gun side of the shadow mask, said coating containing an aluminum-phosphorus compound and fine particles of at least one of tungsten oxide and bismuth oxide.

The second aspect of the present invention is a method for manufacturing a color cathode ray tube, said method comprising the steps of: preparing a suspension containing an aluminum-phosphorus compound and fine particles of at least one of tungsten oxide and bismuth oxide, coating the suspension on a surface of the shadow mask nearest to an electron gun from which electron beams are incident to form a coating film, and calcining the coating film to form a coating on the shadow mask. The resultant shadow mask is arranged on the faceplate such that the coating opposes the electron gun.

The present invention a coating is obtained for improving a purity drift of a shadow mask type color cathode ray tube at a relatively low temperature. Additionally, since the gas release amount is decreased by increased coating adhesion in the present invention, neither the emission characteristic nor the pressure resistance is degraded.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
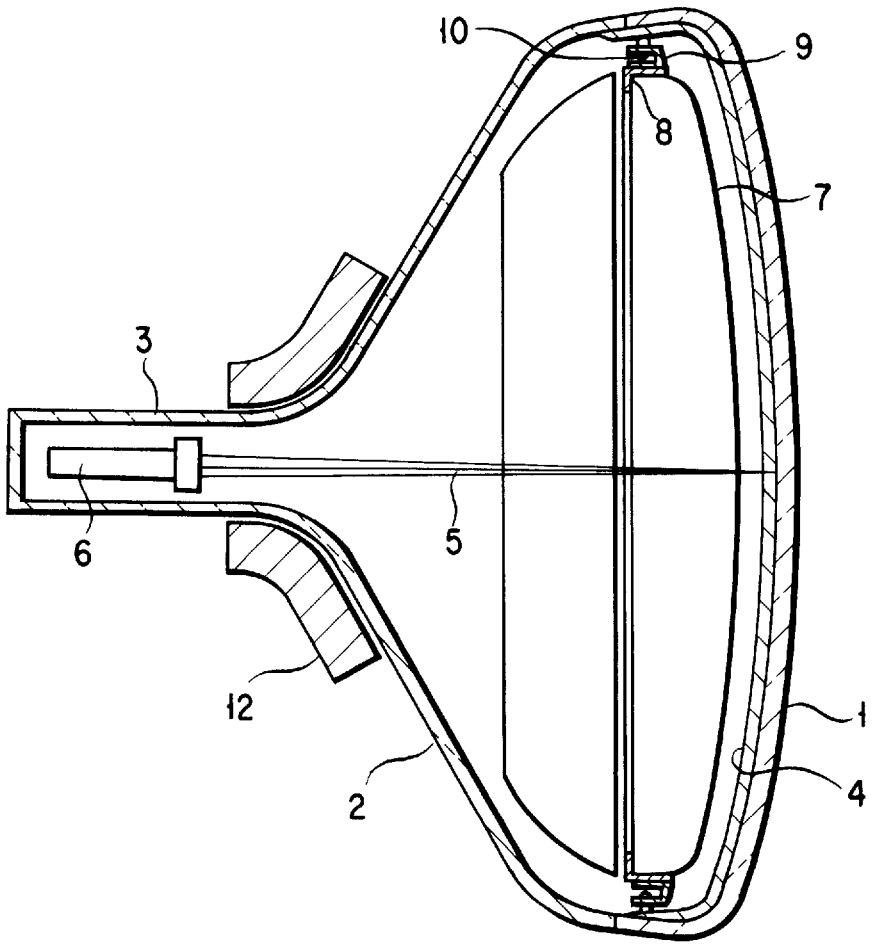
FIG. 1 is a sectional view showing the overall arrangement of a color cathode ray tube according to the present invention.

The present invention is an improvement of a shadow mask for use in a color cathode ray tube.

A shadow mask used in the present invention has a shadow mask substrate and a coating formed on the shadow mask substrate. This coating contains an aluminum-phosphorus compound and fine particles of at least one of tungsten oxide and bismuth oxide.

The coating is formed by, e.g., preparing a suspension containing an aluminum-phosphorus compound and the fine particles of tungsten oxide and/or bismuth oxide, coating the resultant suspension on at least one surface of a shadow mask, and calcining the resultant coating film. The effect of the coating can be obtained by arranging the shadow mask thus manufactured on a faceplate such that the coating opposes an electron gun.

Tungsten and bismuth contained in this coating have large atomic numbers and consequently a high electron reflecting power. Assuming the thermal radiation efficiency of a perfect black body is 1, those of bismuth oxide, tungsten, and tungsten trioxide are 0.80 to 0.85, 0.95 to 0.98, and 0.91 to 0.95, respectively. That is, tungsten trioxide and bismuth oxide have high thermal radiation efficiencies. Therefore, a temperature rise in the shadow mask can be greatly decreased by a high electron beam reflecting power and a high thermal radiation efficiency. This makes it possible to reduce a purity drift caused by thermal expansion of the shadow mask.

In the preferred embodiment, the amount of tungsten oxide and/or bismuth oxide added to the binder is 15 to 60 wt %. If the amount added is smaller than 15 wt %, the effect of suppressing a purity drift tends to be unsatisfied. If the amount added is larger than 60 wt %, the strength of the coating film tends to be weakened, causing the film to peel.

In addition, in the present invention, an aluminum-phosphorus compound gives the coating the electron beam reflecting property and the thermal radiation property discussed above. This allows formation of a coating with a sufficient film strength. Furthermore, the use of the aluminum-phosphorus compound prevents production of a gas when the color cathode ray tube is in operation. This protects the cathode from poisoning by the gas and prevents ion burn of the phosphor of the phosphor screen. That is, the aluminum-phosphorus compound is a water-soluble phosphate containing no alkali metal that does not produce a carbonate, and consequently does not produce a gas during operation. Moreover, although at room temperature aluminum-phosphorus compound is a liquid represented by, e.g., the chemical formula $Al_2O_3.nPO_5.mH_2O$ (n=2 to 5, m=5 to 7), it changes when calcined into a solid represented by, e.g., the chemical formula $Al_2O_3.nP_2O_5.mH_2O$ (n=1 or 2, m=1 or less). This makes formation of a strong coating feasible. In the present invention, $Al_2O_3$~$3P_2O_5$~$6H_2O$ is preferably used as a liquid.

A temperature for calcining preferably ranges between 180° and 600° C. A period for calcining preferably ranges between 30 and 120 minutes.

Note that tungsten trioxide and bismuth oxide are extremely stable substances over a temperature range from room temperature to 500° C. which is used during the manufacturing process of a color cathode ray tube, and are almost insoluble in water or alcohols. Therefore, these particles hardly dissolve after the film formation.

Each of tungsten trioxide and bismuth oxide preferably has a particle size of about 0.2 to 2 $\mu$m, within which range the dispersibility is increased particularly in the suspension.

In addition, by adding boron oxide to the binder, a water-resistant film can be obtained by low-temperature calcination at about 200° C. The amount of this boron oxide is desirably 10 to 25 wt % of the amount of aluminum oxide to be contained in the aluminum phosphate. If the addition amount is smaller than 10 wt %, an objective water resistance cannot be obtained. If the addition amount is larger than 25 wt %, the film strength decreases.

As discussed above, a relatively strong film can be formed by a solution containing an aluminum-phosphorus compound. However, in some cases, the solution may slightly react with the base material of the shadow mask since the solution itself is acidic, causing a decrease in the adhesion. To alleviate problems resulting from a reaction between the solution and the shadow mask material, aluminum oxide or magnesium oxide powder may be added as a filler in the formation of the coating. Specifically, the reaction between the shadow mask and base material is reduced by a reaction between stoichiometrically excess phosphoric acid and aluminum oxide or magnesium oxide. Thus, adding aluminum oxide or magnesium oxide powder further reduces the release of a gas.

The amount of the aluminum oxide powder added can be nearly stoichiometrically equal to excess phosphoric acid contained in the solution made from the aluminum-phosphorus compound. That is, the aluminum-phosphorus compound contains excess phosphoric acid with respect to aluminum oxide, as represented by the chemical formula $Al_2O_3.3P_2O_5.6H_2O$. The addition amount of the aluminum oxide powder is determined as described above in order to effectively use this excess phosphoric acid. The addition of the aluminum oxide powder increases the adhesion of the film because the amount of the excess phosphoric acid which changes into a solid aluminum-phosphorus compound, $Al_2O_3$ $P_2O_5$, increases. A preferable amount of aluminum oxide or magnesium oxide added is 70 to 140 wt % of the amount of the excess phosphoric acid. If the amount added is less than 70 wt %, little increase in film adhesion is realized. If the amount added exceeds 140 wt %, the particle size after the film formation increases, leading to problems such as clogging of the shadow mask apertures or removal of the particles.

Note that a magnesium oxide powder, in place of an aluminum oxide powder, can also be added to the aluminum-phosphorus compound containing solution. With a magnesium oxide powder added, the binder hardens immediately. Therefore, it is desirable to use a two-part mixing-type spray gun to mix and coat a solution having a concentration higher than that of the coating solution in the above embodiment and a magnesium oxide suspension.

Note also that the thickness of the coating is preferably about 2 to 15 $\mu$m. If the thickness is smaller than 2 $\mu$m, the effect of a purity drift tends to be unsatisfied. If the thickness is larger than 15 $\mu$m, the apertures tend to clog more frequently and electron orbits tend to be intercepted making the orbit narrow.

EXAMPLE 1

One example of the present invention will be described below with reference to the accompanying drawings.

As illustrated in FIG. 1, a shadow mask type color cathode ray tube generally has an envelope consisting of a rectangular panel 1, a funnel 2, and a neck 3. Stripes of a phosphor layer 4 which luminesce in red, green, and blue respectively are formed on the inner surface of the panel 1. The neck 3 incorporates an in-line type electron gun 6 for emitting electron beams 5, corresponding to red, green, and blue emitting phosphor layers, arranged in line along the horizontal axis of the panel 1, respectively. A shadow mask 7 having a large number of fine apertures is fixed to a mask frame 8 at a position near the phosphor layer 4, at which the shadow mask 7 opposes the phosphor layer 4. The mask frame 8 is supported in the panel 1 by stud pins 10 embedded in the vertical inner walls of the inner surface of the panel 1 via a holder 9. This permits the spacing between the mask 7 and the phosphor layer 4 to fall within the range of a design value. A deflecting device 12 deflects and scans the electron beams 5, thereby reproducing images. Note that the components of the color cathode ray tube are not limited to the in-line electron gun and the stripe phosphor screen as discussed above, as long as the tube includes a shadow mask.

Figure 2:
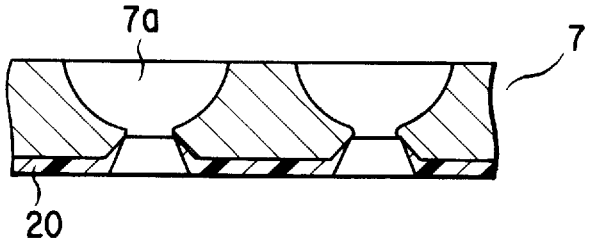
FIG. 2 is a sectional view showing the main components of a shadow mask according to the present invention.

FIG. 2 is a partial sectional view of the shadow mask 7. Referring to FIG. 2, the shadow mask 7 has a number of apertures 7*a*. A coating 20 (to be described later) is formed at least on a non-aperture portion between the apertures 7*a* on the surface opposing the electron gun.

The shadow mask 7 is manufactured by forming a flat mask using photoetching and by molding the mask into a predetermined curved shape. During manufacture, to decrease the mechanical strength of the material, a flat mask having a predetermined aperture size is annealed in a hydrogen reducing atmosphere at 700° C. to 800° C. The resultant flat mask is press-molded to obtain a desired curvature, and is degreased with an organic solvent or a high-temperature alkali solution to remove the molding oil. Thereafter, the resultant mask is passed through a high-temperature gas atmosphere at 550° to 650° C. which contains carbon dioxide gas as the main constituent. Consequently, a corrosion-resistant black oxide film consisting primarily of $Fe_3O_4$ is formed on the surface of the mask. Thereafter, the coating of the present invention is formed on the surface, on the side of the electron gun, of the blackened shadow mask. Note that the black oxide film described above has a corrosion resistance. Therefore, even if pinholes or the like are formed in the coating of the present invention which is constructed from an inorganic substance, this black oxide film suppresses gathering of red rust during the heat treatment step. In addition, the black oxide film has fine projections and recesses compared to the surface of the shadow mask. This improves the adhesion of the coating to make the coating difficult to peel.

The coating 20 of the present invention will be described in detail below.

First, water is added to a liquid aluminum-phosphorus compound represented by the chemical formula $Al_2O_3.3P_2O_5.6H_2O$ to adjust its viscosity to an appropriate value. Thereafter, tungsten oxide particles (average particle size 0.5 $\mu$m) containing tungsten trioxide as the main constituent is added to the material to prepare a suspension. In the preparation, the ratio of the tungsten oxide and the binder containing the aluminum-phosphorus compound was changed in the coating solution, as shown in Table 1.

Each resultant suspension was spray-coated on the surface, on the side on an electron gun, of a shadow mask which was molded as discussed above, and on which the above-mentioned black oxide film was formed, by using an air spray gun or an air-less spray gun, thereby forming a coating film with a predetermined thickness. Since the coating solution had a viscosity coefficient larger than that of ethanol or water, minimal scattering resulted from the spray, and there was almost no sagging of the solution adhered to the shadow mask. Note that the appropriate film thickness is 2 to 15 μm. If the film thickness is less than 2 μm, the doming suppressing effect is decreased. If the film thickness is more than 15 μm, clogging of the shadow mask apertures frequently occurs.

After the suspension was coated, the resultant shadow mask was placed in an oven, dried, and calcined. As an example, the calcination condition is that the shadow mask is heated from room temperature to 100° C. over 10 minutes, kept at that temperature for one hour, again heated to 200° C. over 20 minutes, kept at that temperature for 30 minutes, and then cooled to room temperature at a rate of 10° C./min. The annealed coating film has excellent characteristics at medium temperatures around 200° C. and at high temperatures of 500° C. or higher because of its strong bonding force. Therefore, the film is not adversely affected by heat applied during the manufacturing process. The coating film is also water resistant, not peeling off when washed during the manufacture. The shadow mask on which the coating is formed is transported to the next stage, i.e., the assembly step of a color cathode ray tube, with the coating faced to the electron gun.

If aluminum phosphate used in the solution reacts with iron as the base material of the shadow mask to produce hydrogen, a pressure is applied to the coating from the inside. Consequently, cracks may form in the coating or the adhesion of the coating may deteriorate. Therefore, in case the base material and the solution readily react with each other, it is desirable to use an aluminum-phosphorus compound as the solution. Examples of an effective reagent for forming a complex with the aluminum of the aluminum-phosphorus compound are alcohol amines such as ethanolamine, ethylenediamine, and amino acids such as glycine, sarcosine and alanine.

Note that the complex is preferably a substance which does not remain in the film after the film formation. The complex is more desirably ethanolamine which is a low-molecular-weight, water-soluble substance which readily evaporates or decomposes and dissolves in a solution.

Figure 3:
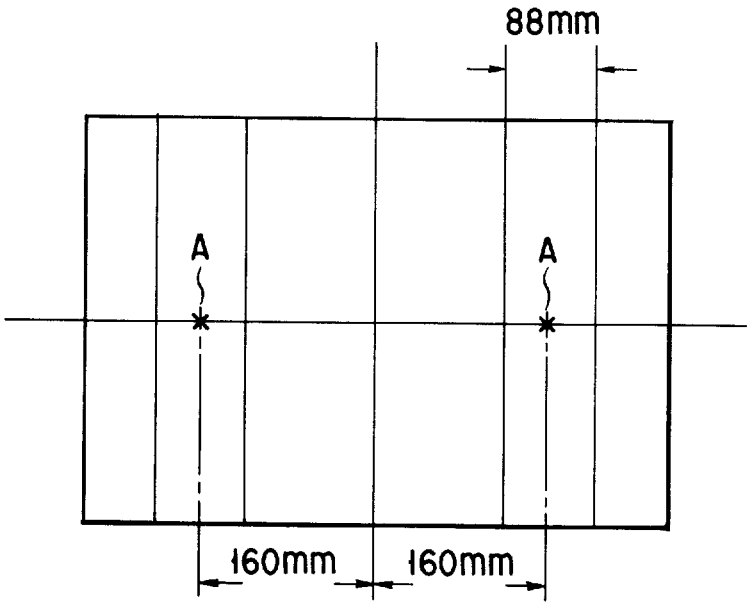
FIG. 3 is a schematic view showing the measurement conditions of a purity drift.

The movement of an electron beam caused by the doming in each of the 25-inch color cathode ray tubes manufactured as discussed above was measured and compared with that of a conventional color cathode ray tube. The measurement was done as shown in FIG. 3. That is, 88-mm wide band-like white patterns were displayed at positions, each separated by 160 mm from the center of the screen along the horizontal axis with an anode voltage of 26 kV and a cathode current of 1330 μA. A maximum movement of an electron beam which moved with time based on the thermal expansion of the shadow mask, after turning on of the power switch, was measured at each measurement point A. The measurement result is given in Table 1.

Note that prior to the manufacture of the color cathode ray tubes, an adhesive tape peel test and a measurement of the water resistance were performed for the coating film of each shadow mask. Table 1 also shows these results.

The adhesive tape peel test was conducted as follows. A cellophane adhesive tape, which size was 18 mm×50 mm, was attached to the surface of the coating film. A rubber eraser was rubbed against the surface of the cellophane adhesive tape so as to make the cellophane adhesive tape completely adhere to the surface of the coating film. Immediately after adhesion, the cellophane adhesive tape was peeled in an instant with keeping a direction of peeling in a vertical to the surface of the coating film, then a sticking matter on the adhesive surface of the cellophane adhesive tape was observed.

The evaluation was done as follows.

○ . . . No adhesion to the tape.

Δ . . . A very slight adhesion to the surface layer.

× . . . Adhesion to some extent to the surface layer.

The water resistance test was done in accordance with JIS K 5400. First, the substrate on which the coating was formed was dipped in water for two hours. Thereafter, whether the coating peeled, swelled, or softened was checked. The evaluation was done as follows.

○ . . . None of creeps, expansion, cracks, peel, and color change occurred.

Δ . . . An extremely small amount of a removed substance was found in the water resistance test bath.

× . . . A removed substance was found to some extent in the water resistance test bath.

As shown in Table 1, the doming suppressing effect of the color cathode ray tubes of this example was improved by 11 to 35% as compared with the conventional color cathode ray tube that was not treated. In addition, deterioration in the emission life characteristic of the cathode after the use of long periods of time remained unchanged from that in the non-treatment case in which no coating was formed. Also, no ion bum of the phosphor was brought about by hydrogen gas inside the tube.

Note that in this example, tungsten oxide was used as the filler in the coating. However, a similar effect can be obtained for the electron beam moving amount even by use of bismuth oxide. In addition, the presence/absence of the aluminum-phosphorus compound as the binder has no effect on the moving amount of an electron beam.

TABLE 1

| Tungsten oxide addition amount (%) | Adhesive tape peel test | Water resistance | Electron beam moving amount (%) |
|---|---|---|---|
| 10 | Δ | Δ | 89 |
| 20 | Δ | Δ | 75 |
| 30 | ○ | ○ | 65 |
| 40 | ○ | ○ | 68 |
| 50 | ○ | ○ | 66 |
| 60 | Δ | ○ | 68 |
| 70 | Δ | Δ | 71 |
| 80 | Δ | Δ | 73 |
| | No coating | | 100 |

EXAMPLE 2

In this example, each suspension used in Example 1 was added with boron oxide $B_2O_3$ at a ratio of 15 wt % of the amount of aluminum oxide contained in aluminum-phosphate compound. The resultant suspensions were used to form coatings under the same coating conditions and calcination as in Example 1.

The characteristics of the color cathode ray tubes according to this example were measured following the same procedures as in Example 1. The results are summarized in Table 2 below.

TABLE 1

| Tungsten oxide addition amount (%) | Adhesive tape peel test | Water resistance | Electron beam moving amount (%) |
|---|---|---|---|
| 10 | Δ | Δ | 88 |
| 20 | Δ | ○ | 73 |
| 30 | ○ | ○ | 65 |
| 40 | ○ | ○ | 69 |
| 50 | ○ | ○ | 67 |
| 60 | ○ | ○ | 70 |
| 70 | Δ | Δ | 70 |
| 80 | Δ | Δ | 71 |
| | No coating | | 100 |

The purity drift suppressing effect of the shadow masks of this example was improved by 12 to 35% compared to that of the non-treated mask. In addition, deterioration in the emission life characteristic of the cathode after the use of long periods of time remained unchanged from that of the cathode ray tube manufactured using the non-treated shadow mask. Also, no ion burn of the phosphor was brought about by hydrogen gas inside the tube. Furthermore, it was possible to form a coating with a sufficient water resistance by low-temperature calcination at about 200° C.

Note that in this example, a similar effect was obtained for the electron beam moving amount even by use of bismuth oxide.

EXAMPLE 3

In this example, boron oxide $B_2O_3$ was added to the aluminum-phosphorus compound ($Al_2O_3.3P_2O_5.6H_2O$) at a ratio of 20% of the amount of aluminum oxide contained in the aluminum-phosphorus compound. Water was added to the resultant material to obtain a proper viscosity. Thereafter, suspensions were prepared by changing tungsten oxide particles following the same procedures as in Example 1. By using these suspensions, coatings were formed under the same coating conditions and calcination conditions as in Example 1. The characteristics of the color cathode ray tubes according to this example were measured following the same procedures as in Example 1. The results are listed in Table 3 below.

TABLE 3

| Tungsten oxide addition amount (%) | Adhesive tape peel test | Water resistance | Electron beam moving amount (%) |
|---|---|---|---|
| 10 | Δ | ○ | 90 |
| 20 | ○ | ○ | 74 |
| 30 | ○ | ○ | 65 |
| 40 | ○ | ○ | 67 |
| 50 | ○ | ○ | 66 |
| 60 | ○ | ○ | 71 |
| 70 | Δ | ○ | 70 |
| 80 | Δ | Δ | 70 |
| | No coating | | 100 |

The purity drift suppressing effect of the shadow masks of this example was improved by 10 to 35% compared to that of the non-treated mask. In addition, deterioration in the emission life characteristic of the cathode after the use of long periods of time remained unchanged from that of the cathode ray tube manufactured using the non-treated shadow mask. Also, no ion burn of the phosphor was brought about by hydrogen gas inside the tube. Note that in this example, a similar effect was obtained for the electron beam moving amount even by use of bismuth oxide.

Each coating film added with a proper amount of aluminum oxide and annealed as discussed above did not peel off even in the above described peel test. In addition, the coating film had superior medium and high-temperature characteristics derived from its strong bonding force. Therefore, the film was not adversely affected by heat applied during the manufacturing process. The coating film also had a water resistance and hence did not peel off by washing during the manufacture.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A color cathode ray tube comprising:

a phosphor screen;

a shadow mask with a large number of apertures arranged in the vicinity of said phosphor screen; and an electron gun generating an electron beam passing through said apertures of said shadow mask to excite said phosphor screen, wherein said shadow mask has a coating which is formed on an electron gun side of said shadow mask, said coating containing an aluminum-phosphorus compound and fine particles of at least one of tungsten oxide and bismuth oxide.

2. A color cathode ray tube according to claim 1, wherein said fine particles account for 15 to 60 wt % of a total coating weight.

3. A color cathode ray tube according to claim 1, wherein a diameter of said fine particles is 0.2 to 2 $\mu$m.

4. A color cathode ray tube according to claim 1, wherein said coating further contains boron oxide.

5. A color cathode ray tube according to claim 4, wherein a content of the boron oxide is 10 to 25 wt % of an amount of aluminum oxide contained in the aluminum-phosphorus compound.

6. A color cathode ray tube according to claim 1, wherein said coating further contains at least one of aluminum oxide and magnesium oxide in an amount corresponding to 70 to 140 wt % of a stoichiometric excess amount of phosphoric acid with respect to aluminum oxide contained in the aluminum-phosphorus compound.

7. A color cathode ray tube according to claim 1, wherein said coating has a film thickness of 2 to 15 $\mu$m.

8. A color cathode ray tube comprising:

a screen;

a shadow mask with apertures arranged in the vicinity of said screen, a coating being formed on a first side of said shadow mask, said coating containing an aluminum-phosphorus compound and fine particles of at least one of tungsten oxide and bismuth oxide; and an electron gun, positioned on the first side of said shadow mask, generating at least one electron beam that is incident on said screen through said apertures of said shadow mask.

9. A color cathode ray tube according to claim 8, wherein said fine particles accounts for 15 to 60 wt % of a total coating weight.

10. A color cathode ray tube according to claim 8, wherein said coating further contains boron oxide.

11. A color cathode ray tube according to claim 10, wherein said boron oxide is 10 to 25 wt % of an amount of aluminum oxide contained in the aluminum-phosphorus compound.

12. A color cathode ray tube according to claim 8, wherein said coating further contains at least one of aluminum oxide and magnesium oxide in an amount corresponding to 70 to 140 wt % of a stoichiometric excess amount of phosphoric acid with respect to aluminum oxide contained in the aluminum-phosphorus compound.

* * * * *